US010232504B1

(12) United States Patent
Whiteside et al.

(10) Patent No.: US 10,232,504 B1
(45) Date of Patent: Mar. 19, 2019

(54) CREEPER WITH ADJUSTABLE HEADREST

(71) Applicant: Whiteside Mfg. Co., Delaware, OH (US)

(72) Inventors: Kirt E. Whiteside, Marion, OH (US); Chad E. Mays, Delaware, OH (US); Terry L. Whiteside, Delaware, OH (US)

(73) Assignee: Whiteside Mfg. Co., Delaware, OH (US)

( * ) Notice: Subject to any disclaimer, the term of this patent is extended or adjusted under 35 U.S.C. 154(b) by 0 days.

(21) Appl. No.: 15/682,713

(22) Filed: Aug. 22, 2017

(51) Int. Cl.
*B25H 5/00* (2006.01)

(52) U.S. Cl.
CPC ..... *B25H 5/00* (2013.01)

(58) Field of Classification Search
CPC ..... A47C 20/043; B25H 5/00
See application file for complete search history.

(56) References Cited

U.S. PATENT DOCUMENTS 1,581,592 A * 4/1926 Neal ..... B25H 5/00 280/32.6
1,593,801 A * 7/1926 Koch ..... B25H 5/00 280/32.6
1,823,526 A * 9/1931 Breeden ..... B25H 5/00 280/32.6
2,051,563 A * 8/1936 Mance ..... B25H 5/00 280/32.6
2,054,598 A * 9/1936 Goldenberg ..... B25H 5/00 280/32.6
2,168,455 A * 8/1939 Smith ..... B25H 5/00 280/32.6
2,430,662 A * 11/1947 Barton ..... B25H 5/00 280/32.6
2,463,410 A * 3/1949 Morris ..... B25H 5/00 248/292.14
2,487,706 A * 11/1949 Happ ..... B25H 5/00 280/32.6
2,509,934 A * 5/1950 Murray ..... B25H 5/00 280/32.6
2,564,323 A * 8/1951 Brown ..... A47C 20/043 280/32.6
2,611,417 A * 9/1952 Henry ..... B25H 5/00 108/129
2,614,271 A * 10/1952 Neil ..... B25H 5/00 280/32.6
2,650,372 A * 9/1953 Lowe ..... B25H 5/00 280/32.6
2,652,576 A * 9/1953 Clark ..... B25H 5/00 280/32.6
2,689,744 A * 9/1954 Mullin ..... B25H 5/00 188/5

(Continued)

*Primary Examiner* — Katy M Ebner
(74) *Attorney, Agent, or Firm* — Renner, Kenner, Greive, Bobak, Taylor & Weber

(57) ABSTRACT

A creeper includes a headrest pad, a body pad carried by a frame, and a hinge assembly between the headrest pad and the body pad. The hinge assembly includes a first bracket attached to the headrest pad and a second bracket attached to the body pad. A first arm is connected to each end of said first bracket and a second arm is attached to each end of the second bracket. A ratcheting hinge is connected between the first arms and between the second arms so that the headrest pad can be positioned at multiple locations relating to the body pad.

4 Claims, 4 Drawing Sheets

(56) References Cited

U.S. PATENT DOCUMENTS 2,703,717 A * 3/1955 Miller ..... B25H 5/00 280/32.6
2,710,758 A * 6/1955 Stettner ..... B25H 5/00 280/32.6
2,780,472 A * 2/1957 Weldon, Sr. ..... B25H 5/00 188/5
2,787,009 A * 4/1957 Hagerty ..... B25H 5/00 5/640
2,804,127 A * 8/1957 Whittingham ..... A61G 13/121 280/32.6
2,861,279 A * 11/1958 Myers ..... A47C 20/042 280/32.6
3,092,394 A * 6/1963 Burke ..... B25H 5/00 280/32.6
3,148,892 A * 9/1964 Merriott ..... B25H 5/00 280/32.6
3,854,154 A * 12/1974 Degen ..... A47C 23/34 5/202
4,185,846 A * 1/1980 Black ..... B25H 5/00 280/11.115
4,889,352 A * 12/1989 Chamberlin, Jr. ..... B25H 5/00 280/30
5,330,211 A * 7/1994 Nicholson ..... B25H 5/00 280/32.6
5,451,068 A * 9/1995 Shockley ..... B25H 5/00 280/32.6
5,577,744 A * 11/1996 Parks ..... B62B 3/02 280/32.6
5,707,067 A * 1/1998 Smith ..... B25H 5/00 280/32.6
6,565,156 B1 * 5/2003 Yamashita ..... A47C 1/026 297/354.12
6,578,857 B1 * 6/2003 Whiteside ..... B25H 5/00 280/32.5
6,718,582 B1 * 4/2004 Tinsley ..... A47C 7/38 5/636
7,481,438 B2 * 1/2009 Hernandez ..... B25H 5/00 280/32.5
9,126,326 B1 * 9/2015 Bowen ..... B25H 5/00
9,623,551 B1 * 4/2017 Bowen ..... B25H 5/00
2004/0227313 A1 * 11/2004 Shockley ..... B25H 5/00 280/32.6
2006/0082084 A1 * 4/2006 Rush ..... B25H 5/00 280/32.6
2007/0235960 A1 * 10/2007 Pantaleoni ..... B25H 5/00 280/32.6

* cited by examiner

CREEPER WITH ADJUSTABLE HEADREST

TECHNICAL FIELD

This invention relates to a creeper such as often used by a mechanic when servicing vehicles. More specifically, this invention relates to such a creeper having a headrest and a body pad wherein the position of the headrest is adjustable in several positions relative to the position of body pad.

BACKGROUND ART

A typical creeper, as used by mechanics or the like, include a pad carried by a frame which is carried by a plurality of wheels which render the creeper mobile. Oftentimes the pad includes a raised headrest portion for the comfort of the user. Sometimes the headrest portion is separate from the remainder of the pad which carries the body of the user. In such instances, it could be possible to pivot the headrest so that it would be selectively flat with the body pad, or it can be positioned at an angle relative to the body pad. However, for most known creepers of that type, the mechanism used to maneuver the headrest is cumbersome and difficult to use, and such usually only permits one relative position between the headrest and the body pad.

DISCLOSURE OF THE INVENTION

It is thus an object of one aspect of the present invention to provide a creeper with a separate headrest and body pads, with the headrest pad being pivotable relative to the body pad.

It is an object of another aspect of the present invention to provide a creeper, as above, which can easily, securely, and safely hold the headrest pad selectively at a plurality of positions relative to the body pad.

These and other objects of the present invention, as well as the advantages thereof over existing prior art forms, which will become apparent from the description to follow, are accomplished by the improvements hereinafter described and claimed.

In general, a creeper made in accordance with the present invention includes a headrest pad, a body pad, and a hinge assembly connecting the headrest pad to the body pad. The hinge assembly includes a first bracket attached to the headrest pad and a second bracket attached to the body pad. The hinge assembly also includes a first arm connected to each end of the first bracket and a second arm connected to each end of the second bracket with a ratcheting hinge being positioned between each first arm and each second arm so that the headrest pad may be positioned at multiple orientations relative to the body pad.

A preferred exemplary creeper according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
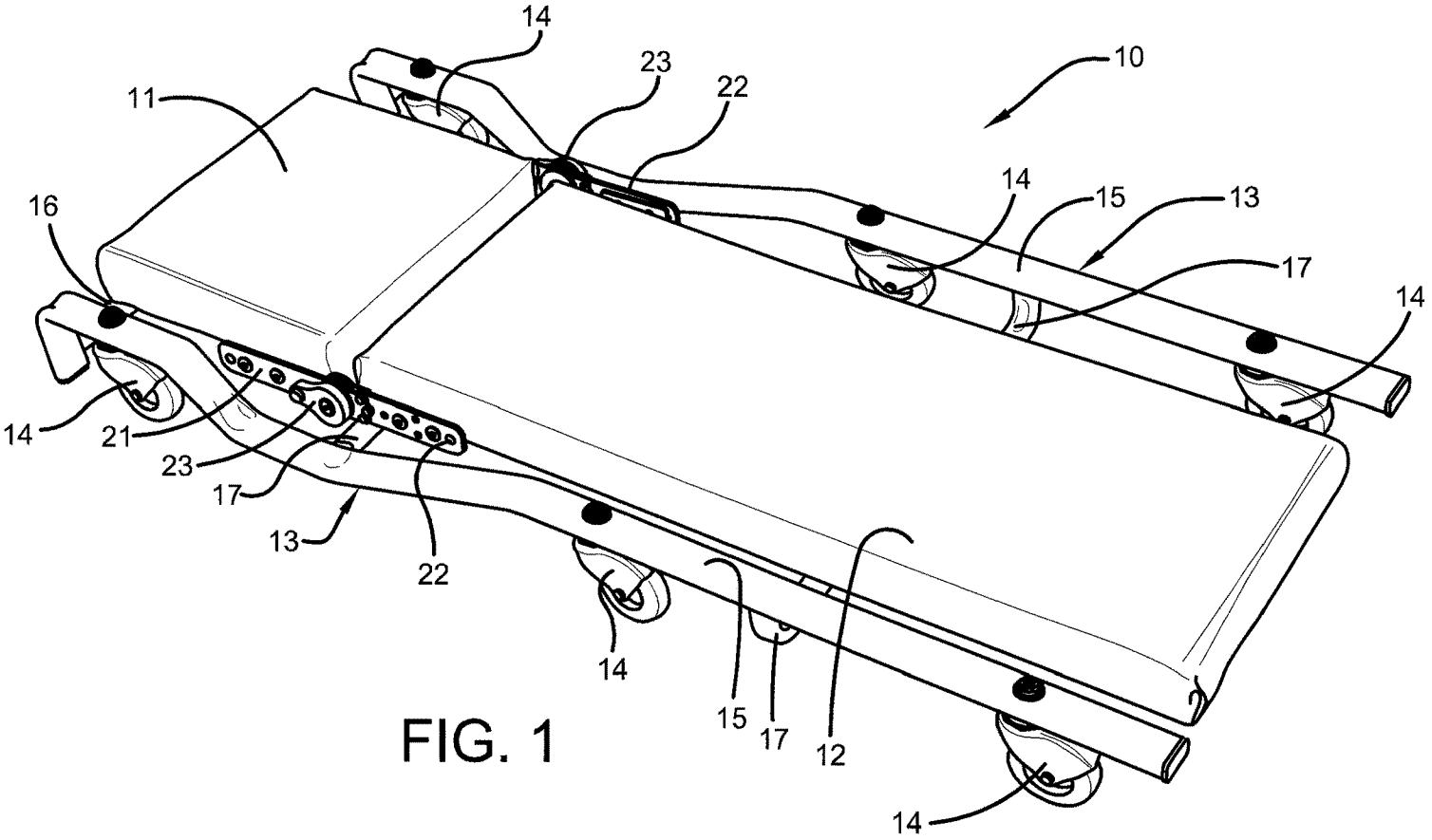
FIG. 1 is a perspective view of a creeper made in accordance with the present invention showing a headrest pad in one position relative to a body pad.

A creeper made in accordance with the present invention is generally indicated by the numeral 10 and includes a headrest pad 11, a body pad 12, a frame generally indicated by the numeral 13, and a plurality of caster assemblies 14 which render creeper 10 mobile.

Frame 13 includes opposed longitudinally extending side rails 15 which are located on each side of pads 11 and 12 and which carry the caster assemblies 14. A crossrail 16 extends between side rails 15 at the head end of creeper 10, and headrest pad 11 rests on crossrail 16 when it is in the FIG. 1 position on the same plane as body pad 12. Body pad 12 is carried by and attached to a plurality of additional crossrails 17 which are longitudinally spaced between side rails 15.

Figure 5:
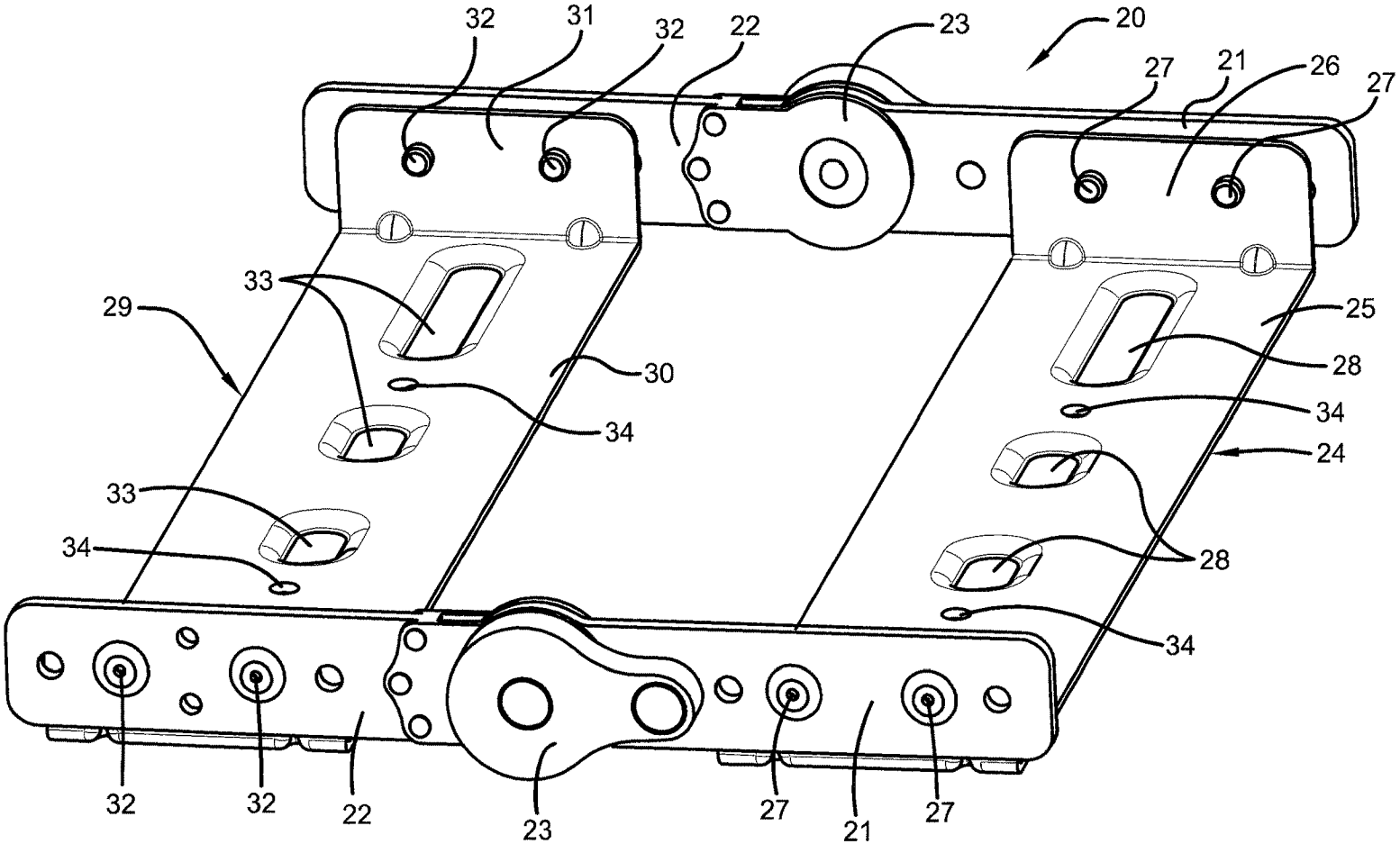
FIG. 5 is a perspective view of the hinge assembly which connects the headrest pad to the body pad.

A hinge assembly, generally indicated by the numeral 20 and best shown in FIG. 5, pivotally attaches headrest pad 11 to body pad 12. To that end, hinge assembly 20 includes opposed first arms 21 and opposed second arms 22 with each arm 21 and each arm 22 being connected to each other by opposed ratcheting hinges 23. As is known in the art, ratcheting hinges allow arms 21 and 22 to be pivoted relative to each other in incremental steps.

Hinge assembly 20 also includes a first bracket, generally indicated by the numeral 24, which has a base portion 25 with flanges 26 at each end. Bracket 24 extends between first arms 21 and its flanges 26 are attached to arms 21 by suitable fasteners 27. A plurality of gussets 28 may be formed on base portion 25 to provide strength thereto. A second bracket can be identical to first bracket 24 and is generally indicated by the numeral 29. Second bracket 29 thus includes a base portion 30 with flanges 31 at each end. Bracket 29 extends between second arms 22 and its flanges 31 are attached to arms 22 by suitable fasteners 32. A plurality of gussets 32 may be forced on base portion 30 to provide strength thereto.

Figure 2:
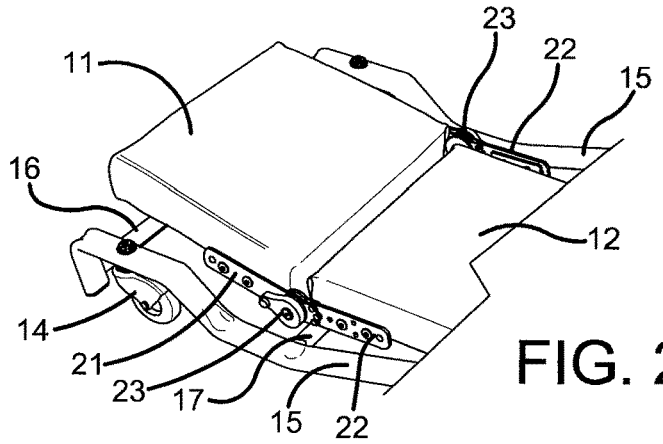
FIG. 2 is a fragmented perspective view of the creeper showing the headrest pad in a second position relative to the body pad.
Figure 3:
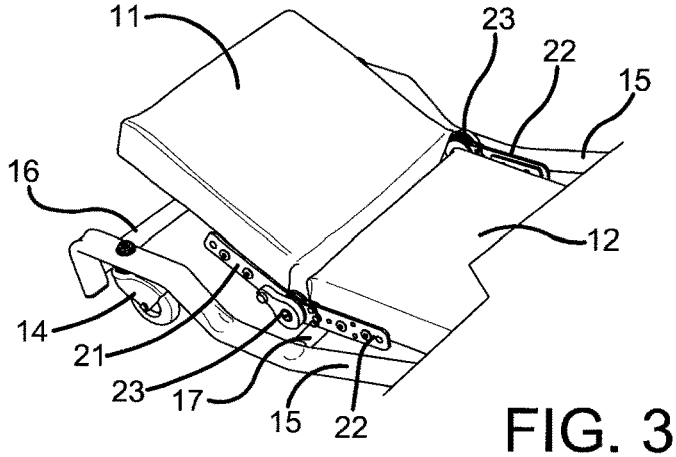
FIG. 3 is a fragmented perspective view of the creeper showing the headrest pad in a third position relative to the body pad.
Figure 4:
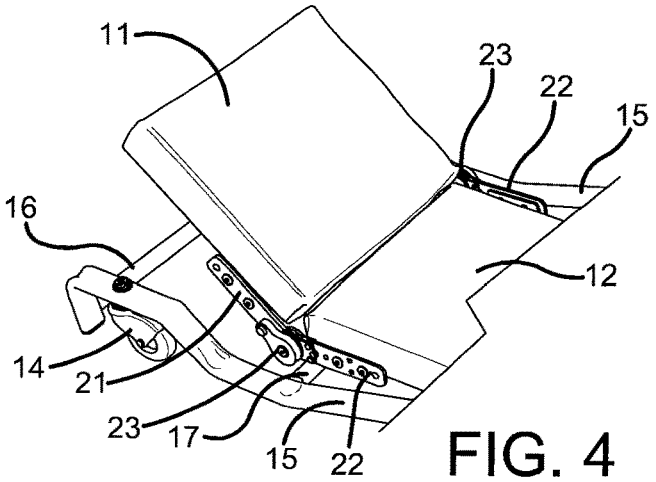
FIG. 4 is a fragmented perspective view of the creeper showing the headrest pad in a fourth position relative to the body pad.
Figure 6:
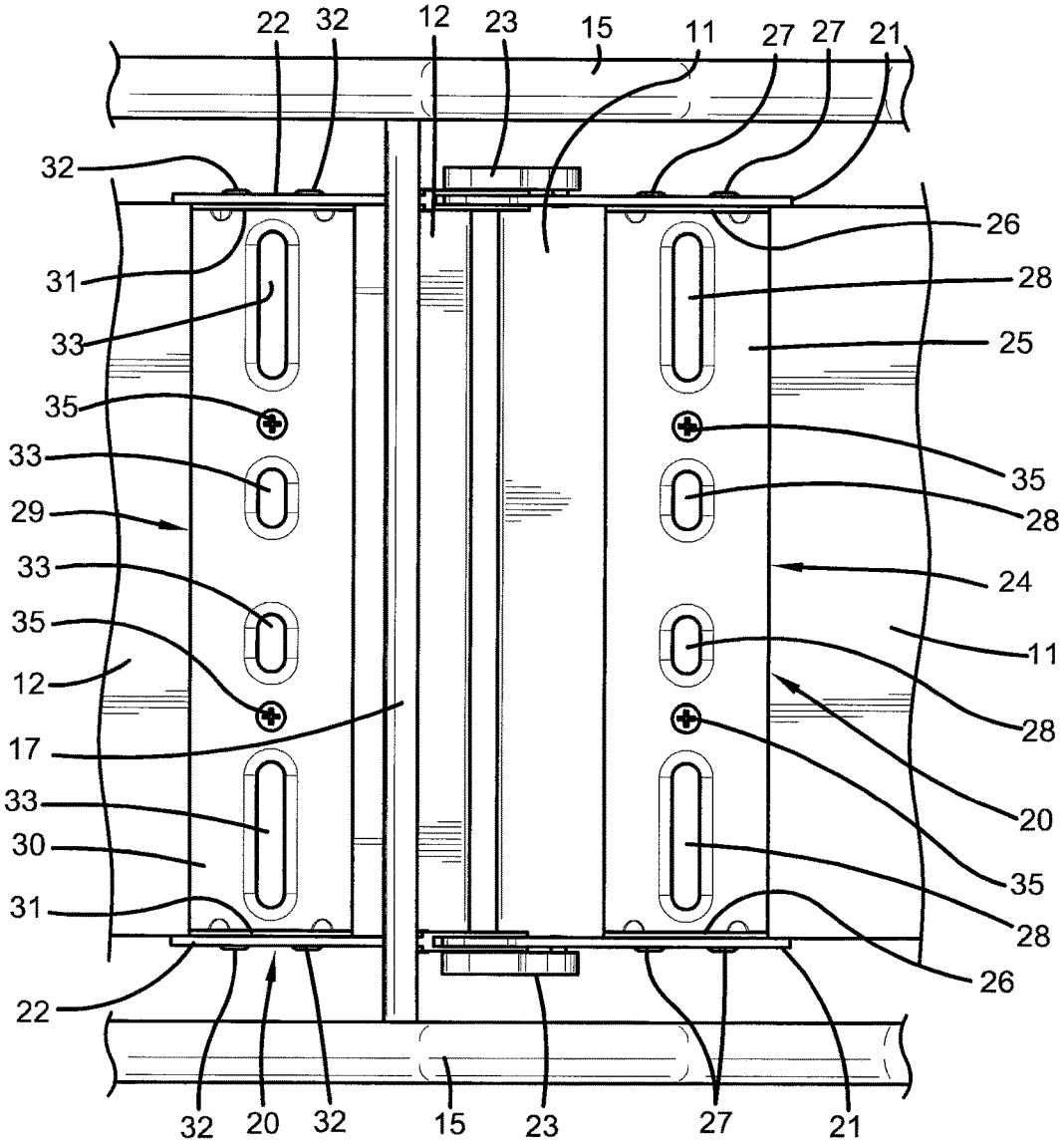
FIG. 6 is a fragmented bottom plan view of the creeper showing the hinge assembly mounted on the bottom of the pads.

Base portions 25 and 30 of brackets 24 and 29, respectively, are provided with apertures 34 so that hinge assembly 20 can be attached to pads 11 and 12 by fasteners 35 as shown in FIG. 6. One bracket 24 or 29 thus extends across and is attached to headrest pad 11 and the other bracket 24 or 29 extends across and is attached to body pad 12. Ratcheting hinges 23 are thus effectively attached to each other on creeper 10 by brackets 24 and 29. As a result, with one hand, a user is able to grasp the end of headrest pad 11 and ratchet it through a plurality of angular orientations relative to body pad 12 as shown in FIGS. 2-4. In each position, the orientation is fully held in place until the user again pulls on headrest pad 11 to position it at another location. When pad 11 has reached the most upright position allowed by ratcheting hinges 23, for example, the position shown in FIG. 4, pulling on it one more allows the mechanisms of the ratcheting hinges 23 to release pad 11 so that it will return to its position shown in FIG. 1. While FIGS. 1-4 depict four relative positions of pads 11 and 12, it should be evident that any number of positions could be provided dependent on the ratcheting hinges 23 selected.

It should thus be evident that a creeper constructed as described herein accomplishes the objects of the present invention and such substantially improves the art.

What is claimed is:

1. A creeper comprising a headrest pad, a body pad, and a hinge assembly connecting said headrest pad to said body pad; said hinge assembly including a first unitary bracket attached to said headrest pad, said first bracket including a base portion attached to and extending across the bottom of said headrest pad and a flange extending outwardly from each end of said base portion and extending away from said pads, a second unitary bracket attached to said body pad, said second bracket including a base portion attached to and extending across the bottom of said body pad and a flange extending outwardly from each end of said base portion, and extending away from said pads, a pair of first arms, one of said first arms being directly connected to each said flange of said first bracket, a pair of second arms, one of said second arms being directly connected to each said flange of said second bracket, a first ratcheting hinge positioned between one of said pair of first arms and one of said pair of second arms, and a second ratcheting hinge positioned between the other of said pair of first arms and the other of said pair of second arms, the ratcheting hinges operating so that said headrest pad can be positioned at multiple orientations relative to said body pad.

2. The creeper of claim 1 wherein both said base portions are provided with a plurality of gussets.

3. The creeper of claim 1 further comprising a frame, said body pad being attached to said frame.

4. The creeper of claim 3 further comprising a plurality of caster assemblies carried by said frame.

* * * * *